US005496969A

United States Patent [19]

Blackmore

[11] Patent Number: 5,496,969

[45] **Date of Patent: * Mar. 5, 1996**

[54] CONCENTRIC COMPRESSED UNILAY STRANDED CONDUCTORS

[75] Inventor: Andrew Blackmore, King City, Canada

[73] Assignee: Ceeco Machinery Manufacturing Ltd., Concord, Canada

[ * ] Notice: The portion of the term of this patent subsequent to Nov. 9, 2010, has been disclaimed.

[21] Appl. No.: 48,321

[22] Filed: Jul. 26, 1993

Related U.S. Application Data

[63] Continuation-in-part of Ser. No. 873,312, Apr. 24, 1992, Pat. No. 5,260,516.

[51] Int. Cl.[6] ..... H01B 7/00; D02G 3/36; D07B 1/06

[52] U.S. Cl. ..... 174/113 R; 57/9; 57/15; 57/218; 57/219; 174/113 A; 174/126.1; 174/128.1; 174/129 R; 174/130

[58] Field of Search ..... 174/113 R, 113 A, 174/128.1, 126.1, 130, 133 R, 129 R, 113 A; 57/9, 15, 16, 214, 215, 217

[56] References Cited

U.S. PATENT DOCUMENTS

| | | | |
|---|---|---|---|
| 1,393,750 | 10/1921 | Carter . | |
| 1,691,921 | 11/1928 | Davis | 174/129 S |
| 1,692,767 | 11/1928 | Davis | 174/129 S |
| 1,943,087 | 1/1934 | Potter et al. | 174/130 X |
| 3,131,469 | 5/1964 | Glaze | 174/128.1 |
| 3,339,012 | 8/1967 | Hutchins, Jr. | 174/128.1 |
| 3,352,098 | 11/1967 | Gilmore | 174/128.1 |
| 3,383,704 | 5/1968 | Schoerner et al. | 57/215 |
| 3,444,684 | 5/1969 | Schoerner et al. | 57/9 |
| 4,471,161 | 9/1984 | Drummond | 174/130 A |
| 4,473,995 | 10/1984 | Gentry | 57/9 |
| 4,571,453 | 2/1986 | Takaoka et al. | 174/110 A |
| 4,687,884 | 8/1987 | DeHart | 174/130 |
| 5,133,121 | 7/1992 | Birbeck | 174/128.1 |
| 5,149,917 | 9/1992 | Sawada et al. | 174/129 R |
| 5,216,205 | 6/1993 | Fujii et al. | 174/128.1 |
| 5,260,516 | 11/1993 | Blackmore | 174/113 A |

FOREIGN PATENT DOCUMENTS

| | | | |
|---|---|---|---|
| 1166187 | 11/1958 | France | 174/128.1 |
| 909714 | 3/1954 | Germany | 174/129 R |
| 673219 | 6/1952 | United Kingdom | 174/129 S |

*Primary Examiner*—Morris H. Nimmo
*Attorney, Agent, or Firm*—Lackenbach Siegel Marzullo Aronson & Greenspan

[57] ABSTRACT

Concentric Compressed Unilay Stranded Conductors are formed of certain combinations of compressed wires, such as 1+7+12, 1+6+11 or 1+7+12+17, which have nominally equal diameters. The combinations of conductors or wires are selected so that the number of wires in any two adjacent layers, including a central layer, are not divisible by a common number with the exception of the integer one. The stranded conductors are optionally formed to have sectored cross-sectional configurations.

30 Claims, 5 Drawing Sheets

CONCENTRIC COMPRESSED UNILAY STRANDED CONDUCTORS

CROSS-SECTION TO RELATED APPLICATION

This application is a continuation-in-part of U.S. application Ser. No. 07/873,312 filed Apr. 24, 1992, issued as U.S. Pat. No. 5,260,516.

BACKGROUND OF THE INVENTION

1. Field of the Invention

This invention generally relates to stranded cable manufacturing and more particularly to the manufacturing process for producing compressed concentric unilay stranded round, sectored and pre-spiraled sectored conductors with high speed single or double twist machinery, and cables and conductors produced thereby.

2. Description of the Prior Art

Compressed stranded cable conductors are well known in the art. Examples are disclosed in U.S. Pat. No. 4,473,995, 3,383,704 and 3,444,684. Such cables are preferred over uncompressed cables or compacted cables for several reasons. Compressed conductors typically have a nominal fill factor from about 81% to 84% Fill factor is defined as the ratio of the total cross-section of the wires in relation to the area of the circle that envelops the strand.

Uncompressed cables require the maximum amount of insulation because the cable diameter is not reduced and because interstitial valleys or grooves between the outer strands are filled with insulation material. Typical fill factors for these conductors are about 76%. On the other hand, compact conductors, although eliminating the above-mentioned drawbacks, might have physical properties that are not desirable for specific applications. Typical fill factors for these constructions range from 91% to 94%.

Multiwire compressed conductor strands are made in different configurations and by many different methods. Each method and configuration has advantages and disadvantages. One approach is to form the strand with a central wire surrounded by one or more helically layered wires. The strand is made by twisting the wires of each layer about the central wire with a wire twisting machine. A true concentric strand is one example of a strand made by this method. Each layer of a true concentric strand has a reverse lay and an increased length of lay with respect to the preceding layer. In case of a 19-wire conductor strand, two passes might be required through a wire twisting machine to make the strand.

One example of a known strand involves one pass for a 6-wire layer having, for example, a Right Hand lay over the central wire and a second pass for a 12-wire layer having a Left Hand lay over the first six wire layer. The strand can also be made in one pass with machines having cages rotating in opposite directions applying both layers at the same time, but the productivity of such machines is very low.

A unilay conductor is a second example of a conductor strand having helically laid layers disposed about the central wire. Each layer of a unilay strand has the same direction of lay and the same length of lay. Because each layer has the same lay length and same direction, the strand may be made in a single pass. As a result, productivity increases.

Unilay strands are used in a variety of configurations and commonly for sizes up to and including 240 sq. mm.

These strands can be manufactured either on a Single Twist machine or a Double Twist machine. The Single Twist machine has advantages over the Double Twist machine since strands made on such machines are generally more uniform than those used on Double Twist machines. This occurs because of the difficulty in a double twist machine of controlling the tension of the wire entering the closing die and because of the second twist that is applied to the wires after the cable has already been subjected to the first twist.

However, Double Twist machines have the advantage of higher productivity than Single Twist machines because, by its configuration, a Double Twist machine imparts two twists for each revolution of the flyer. Moreover, because of differences in construction, Double Twist machines can easily operate at higher rotational speeds than single twist machines.

As a result, the output of Double Twist machines is often more than three times the output of Single Twist machines for a similar strand.

Referring to FIG. 1, one of the most commonly used unilay conductors is a conductor $S_1$ formed with 19 wires of the same diameter D. In such a strand, the six wires 4 of the inner layer $L_1$ and the twelve wires 6 of the outer layer $L_2$ are twisted about the central core wire 2 in the same way and in a concentric pattern. Normally a hexagonal pattern (dash outline H) is formed, and not the desired round configuration C. This hexagonal configuration presents many basic problems because the circumscribing circle C creates six voids V. These voids are filled with insulation requiring more insulation for a minimum insulation thickness as compared with a true concentric strand.

Experience has also shown that the wires at the corners tend to change position and to back up during extrusion.

As a result of this concern, engineers in the conductor wire industry have been seeking to develop conductor strands which maintain a circular cross-section and increase the uniformity of the conductor section.

One approach is to try to position the outer twelve conductors in such a way as to have each two wires *6a*, *6b* at the second layer $L_2$ perched on the surface of one of the six wires 4 of the first layer $L_1$. Such conductor $S_2$, shown in FIG. 2, is sometimes referred to as having a "smooth body" construction which avoids the problem mentioned above in connection with the conductor 2 in FIG. 1.

However, the "smooth body" construction is not stable and cannot be easily achieved on a commercial basis without considerably reducing the lays and, therefore, the productivity of the machines. Furthermore, any variation in wire diameter or tension in the wires can cause the conductor strand to change into the hexagonal configuration shown in FIG. 1 which represents the stable, low energy construction.

Another attempt to solve the problem has been to make a composite strand $S_3$ in accordance with U.S. Pat. No. 4,471,161 and shown in FIG. 3. This last construction has the advantage of being stable, but the disadvantage of requiring wires *6c*, *6d* with different diameters $D_1$, $D_2$ in the second layer $L_2$. However, in order to maintain a circular outer cross-section, the diameters $D_1$, $D_2$ which must be selected result in gaps or grooves G between the wires into which insulation can penetrate. A variation on this idea is represented in FIG. 4 where the 7-wire core (1+6) is compressed, such compression allowing the smaller diameter wires *6d* to move radially inwardly to a degree which substantially eliminates the tangential gaps in the 12-wire layer $L_2$.

Another solution has been to use a combination of formed or shaped and round elements or wires to assure that the desired fill factor is realized with a stable strand design minimizing the outer gap area and optimizing the use of the insulating material. One example of such a strand uses a combination of 7 "T" shaped elements with 12 round elements providing a stable strand design. Such constructions are shown in publication No. 211091 published by Ceeco Machinery Manufacturing Limited, at page 537-7. In this construction, the outer 12 elements or wires are in contact with each other thereby minimizing the grooves or spaces and the fill factor is approximately 84%. In such a configuration, the outside wires abut against the flat surfaces of the inner layer and have no tendency to collapse into the minimal spaces or grooves therein. A modification of the aforementioned strand involves various degrees of compression of the outer round wires with the result that the range of fill factors can be increased from approximately 84 to 91%. Because the inner layer of the 7 conductors is also compacted in the inner layer elements produce a substantially cylindrical outer surface with interstitial grooves minimized or substantially eliminated. While this eliminates the aforementioned problem of the outer layer collapsing into the grooves of the inner layer, such cables have fill factors that are too high for many applications.

SUMMARY OF THE INVENTION

According to the present invention, a multi-layer conductor can be manufactured in such a way as to eliminate the problems mentioned in the prior art while maintaining a high manufacturing efficiency.

The strand will also have the physical characteristics that are desirable for a wide range of applications such as concentricity and a fill factor that will compare favorably with the traditional reverse lay concentric compressed strand.

More specifically, a multi-wired strand of unilay construction in accordance with the present invention comprises a central layer consisting of at least one wire. At least one additional layer of wires is stranded about said central layer. Said wires in both said central layer and additional layers being such that the number of wires in adjacent layers are integers that are not divisible by a common number with the exception of the integer one. The wires of at least one of the layers are compressed to provide area reductions. The number of wires in each of the layers is selected such that adjacent wires in each of the layers, with appropriate area reductions, are substantially in contact with each other and the strand configuration has a stable substantially circular or sectored cross-section. The strand may be manufactured with wires having the same diameter, but the numbers of wires in the central layer and each additional layer will have the characteristics of not being divisible by any common number but the integer one. This will create a condition whereby the wires in each layer will not find more than one corresponding helical groove in the central layer or a previous layer to fall or collapse into. This may require area reductions in the wires in the central or in one or more additional layers so that with a number of wires selected in the central layer or in any given additional layer are substantially in contact or in very close proximity with each other.

The invention also includes the method of forming a multi-wire strand of unilay construction. The method comprises the steps of stranding at least one additional layer of wires about a central layer consisting of at least one wire. The central layer may consist of a layer of wires that serves as the innermost layer. One or more additional layers of wires may be successively stranded about the central layer of wires. The number of wires in said central layer and additional layers being such that the number of wires in adjacent layers are integers that are not divisible by a common number with the exception of the integer one. The wires are compressed in at least one of the layers to provide area reductions therein. The number of wires in each of the layers is selected such that adjacent wires in each of the layers, with appropriate area reductions, are substantially in contact with each other and the strand configuration has a stable substantially circular or sectored cross-section.

BRIEF DESCRIPTION OF THE DRAWINGS

The aforementioned and other features of the present invention will become more apparent from the following discussion and the accompanying drawings, wherein.

DESCRIPTION OF THE PREFERRED EMBODIMENTS

Figure 5:
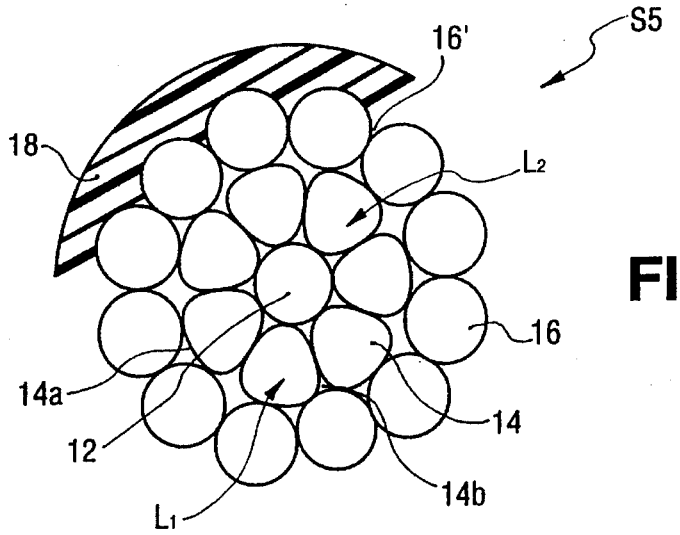
FIG. 5 is similar to the aforementioned figures, but showing a strand construction in accordance with the present invention, wherein the intermediate layer is formed of 7 radially compressed wires, on which 12 circular wires are wound and showing a portion of the insulation that is typically applied to the strand.

Referring now more specifically to the Figures, in which the identical or similar parts are designated by the same reference numerals throughout, and first referring to FIG. 5, a 20 wire concentric compressed unilay strand in accordance with the invention is illustrated, in cross-section, and designated by the reference designation $S_5$.

The strand $S_5$ formed in accordance with the present invention includes a first or central layer or core wire 12 surrounded by a further or additional layer of intermediate conductors or wires 14. The conductors or wires 14 are initially nominally the same size as the central core wire 12. One of the constructions in accordance with the present invention includes 7 wires in the intermediate layer $L_1$. In order to achieve such a construction, it is necessary to compress the wires 14 of the intermediate layer $L_1$ so as to squeeze or compress these wires together by applying radially inward forces, as by passage through a die. Once passed the die, the conductors 14 exhibit flattened radially outward surfaces **14*a* and interstitial grooves 14*b*. The compression of the wires 14** through a die results in area reduction consistent with the standards for compressed wires.

Wrapped about the intermediate or inner layer $L_1$ is an outer layer $L_2$ of wires 16, wound with the same lay as the intermediate layer. The wires 16 have the same nominal diameter as the wire 12 and the same as the initial diameters of the wires 14. Twelve such wires 16 are applied, forming interstitial grooves 16' between adjacent wires in the outer layer.

Figure 1:
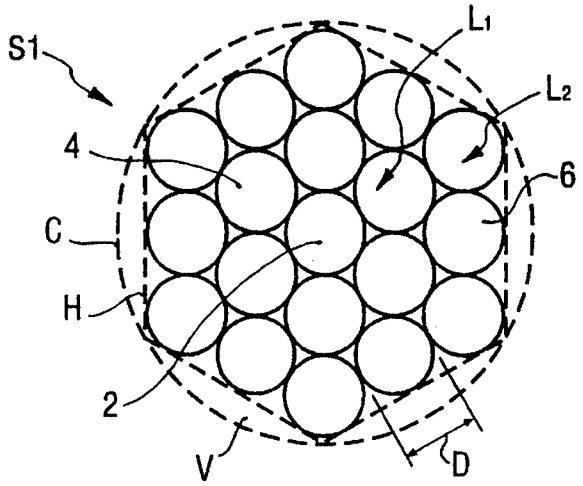
FIG.1 (PRIOR ART)
FIG. 1 is a pictorial end view representation of a prior art strand consisting of 19 wires of the same diameter, including a core wire, six wires of an inner layer and twelve wires of an outer layer, which are twisted about the central wire, shown collapsed into a hexagonal pattern as a result of the outer layer wires being received within the interstitial grooves formed by the intermediate layer wires.

The strand $S_5$ in FIG. 5 represents a stable cable which cannot, due to movements, stresses, or the like, collapse into the hexagonal configuration illustrated in FIG. 1. Accordingly, the strand $S_5$ retains its circular external cross-section or cylindrical configuration. The strand $S_5$ can be used without the insulation, although it can be passed through a sheathing device which extrudes a sheath or a layer 18 of insulation material. Because the 6 voids V shown in FIG. 1 are non-existent, the amount of insulation 18 applied to the strand $S_5$ will be minimized.

Figure 6:
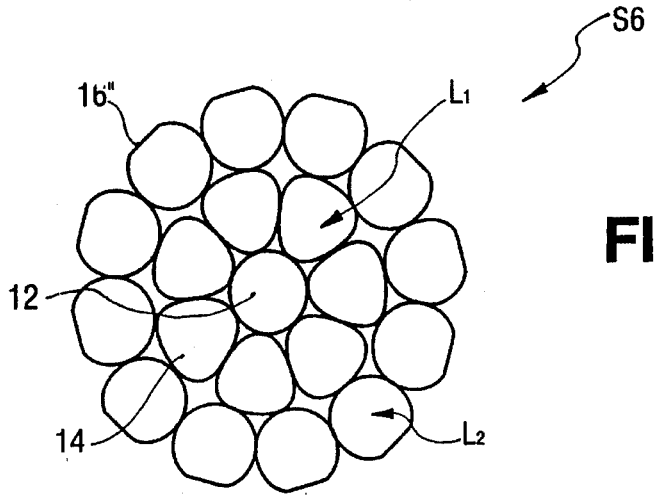
FIG. 6 is similar to FIG. 5, except that both the intermediate layer of 7 wires as well as the outer layer of 12 wires are radially compressed so that both layers experience area reductions and together form a composite strand which has a somewhat smaller diameter and exhibits a smoother and rounder outer surface.

In FIG. 6 a strand $S_6$ is depicted, which is very similar to the strand $S_5$ shown in FIG. 5, both strands consisting of 1+7+12 conductors formed of concentric compressed unilay wires. However, in the embodiment shown in FIG. 6 the strand is enhanced by being pulled through a sizing die in which the wires 16 in the outer layer $L_2$ are compressed radially inwardly to form radially outwardly facing flattened surfaces 16", this assuring the concentricity and dimensional integrity of the strand.

An important feature of the present invention is that the number of wires in adjacent layers, including the central layer, are integers that are not divisible by a common number with the exception of the integer 1. Thus, in the embodiments shown in FIGS. 5 and 6, the numbers of wires in the central layer and layers $L_1$, $L_2$ are not divisible by any common denominator with the exception of the integer 1. This assures that a layer cannot collapse, with the exception of possibly one wire, into the interstitial grooves formed in the immediately adjacent radially inner layer in contact therewith.

By selecting the appropriate number of conductors or wires, and compressing these layers within the range of approximately 0–20%, the number of wires in each of the layers, with appropriate area reductions, are in substantial contact with each other as shown, and the strand configurations have stable cross-sections. "Substantial contact" is defined as such contact between adjacent conductors that prevent pressure extrudate from penetrating gaps between the adjacent conductors. Area reductions, therefore, that may be appropriate are such area reductions that provide such substantial contact without exceeding the tensile strengths of the conductors that would result in breaking or damage to the conductors. The compression of the conductors will, therefore, vary from case to case and the aforementioned range of 0–20% is intended to cover the typical or normal applications.

Figure 7:
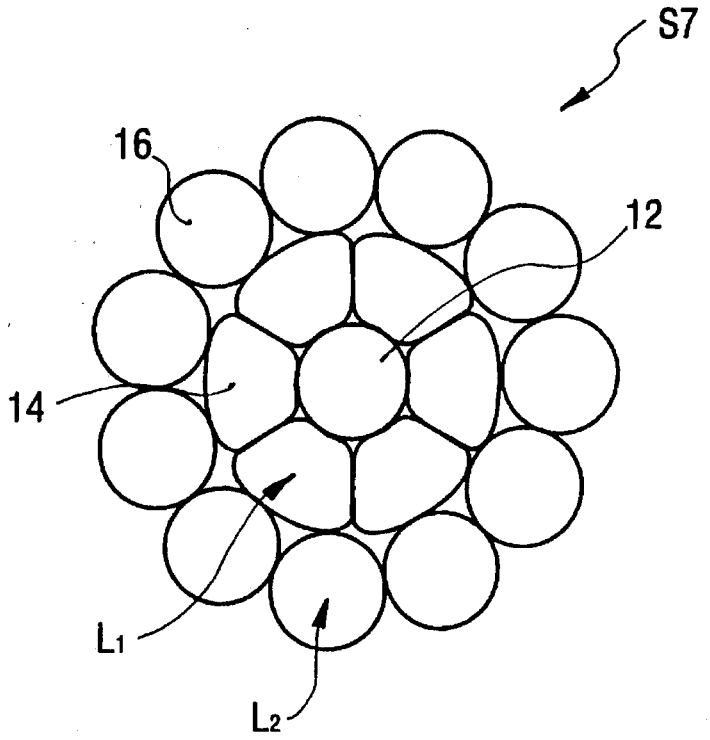
FIG. 7 is similar to FIG 5, and 6, except that the intermediate layer is formed of 6 wires radially compressed, on which 11 circular wires are wound.
Figure 8:
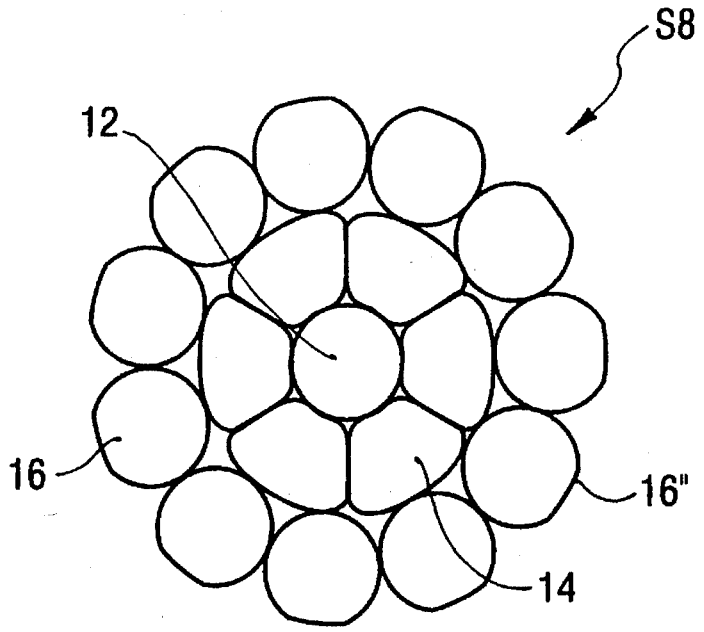
FIG. 8 is similar to FIG. 7, except that both the intermediate layer of 6 wires as well as the outer layer of 11 wires are both axially compressed to present radially outward flattened surfaces.

Referring to FIG. 7, another construction in accordance with the present invention is illustrated, formed of 1+6+11 wires. This strand $S_7$ includes a first or central layer in the nature of a circular core wire 12. The subsequent layer $L_1$ is formed of 6 wires which are radially inwardly compressed, by passage through a die, so as to flatten the outer cylindrical surfaces thereof as shown in FIG. 7. However, since only 6 conductors 14 are used in the layer $L_1$, and since the wires in that layer have an initial or nominal diameter which is the same as that of the core wire 12, it should be clear that the wires 12 must be compressed to a greater extent than those in the embodiments $S_5$ and $S_6$. The 11 wires 16 forming on the outer layer $L_2$ are circular in configuration, are not compressed and have the same nominal diameters as the other wires in the strand. Eleven wires 16 can be applied and adjacent wires touch each other when the intermediate layer $L_1$ has been adequately compressed to reduce the outer diameter of the intermediate layer wires 14, thereby forming a smaller circumference on which the 11 wires can be applied. The embodiment $S_8$ shown in FIG. 8 is similar to that shown in FIG. 7, with the exception that the 11 wires formed in the outer layer $L_2$ are compressed by passage through a sizing die to form flattened radially outward surfaces 16" as shown.

Figure 9:
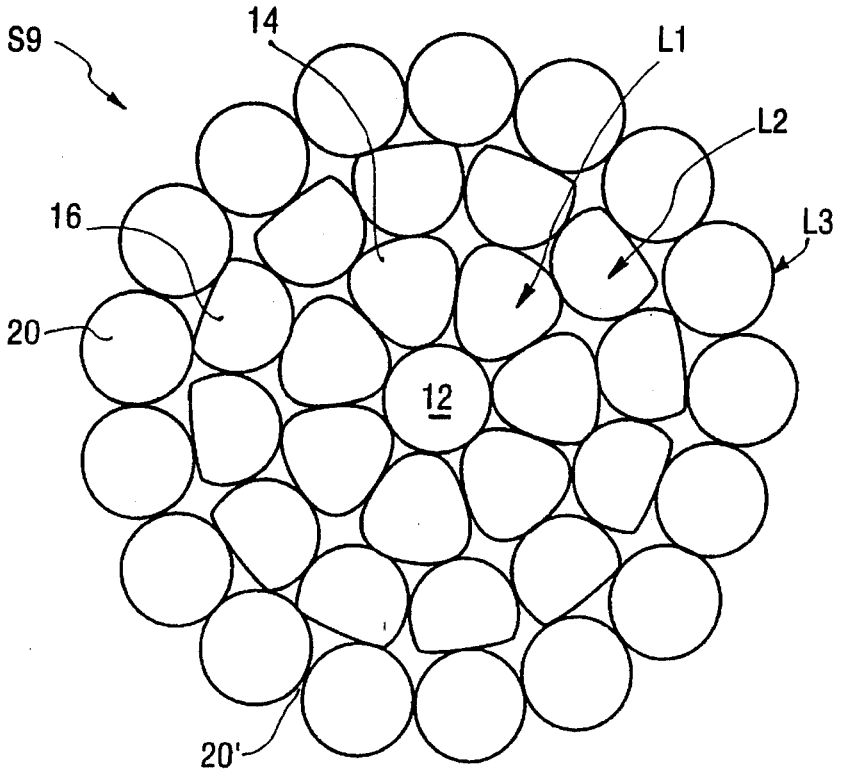
FIG. 9 is similar to FIG. 6 showing a 1+7+12+17 strand in which the first two layers wound about the core wire are compressed on which a third layer of circular wires is wound.

Referring to FIG. 9, a further construction in accordance with the invention is shown, formed of 1+7+12+17 wires. This strand $S_9$ is similar to the strand $S_6$ shown in FIG. 6, in which the two layers $L_1$ and $L_2$ are both compressed. However, an additional layer $L_3$ is wound over the layer $L_2$ composed of non-compressed circular wires 20. As a result, interstitial grooves 20' are formed which are comparable in dimensions to those grooves 16' shown in FIG. 5. When the strand $S_9$ is passed through a sizing die, the layer $L_3$ is likewise compressed to form strand $S_{10}$ shown in FIG. 10. As with the strand $S_6$ in FIG. 6, the sizing results in flattened exterior surfaces 20", similar to surfaces 16" shown in FIG. 6. Thus the presently preferred embodiments of strands of the present invention are constructions which are formed of certain combinations of compressed wires, such as 1+7+12, 1+6+11 or 1+7+12+17, which have nominally equal input wire diameters for the same strand design. The 1+7+12 construction is presently preferred because it has a 81% fill factor, this being more consistent with existing cables in accordance with the North American Specifications. The embodiments which include 1+6+11 wires, as described, are also satisfactory, but with fill factors of approximately 83.3%. Fill factors of approximately 80–85% can be used, although the preferred range is 81–84%, particularly if the compressed conductors are again compressed or formed into strands having sector cross-sections as will be more fully discussed below.

Figure 10:
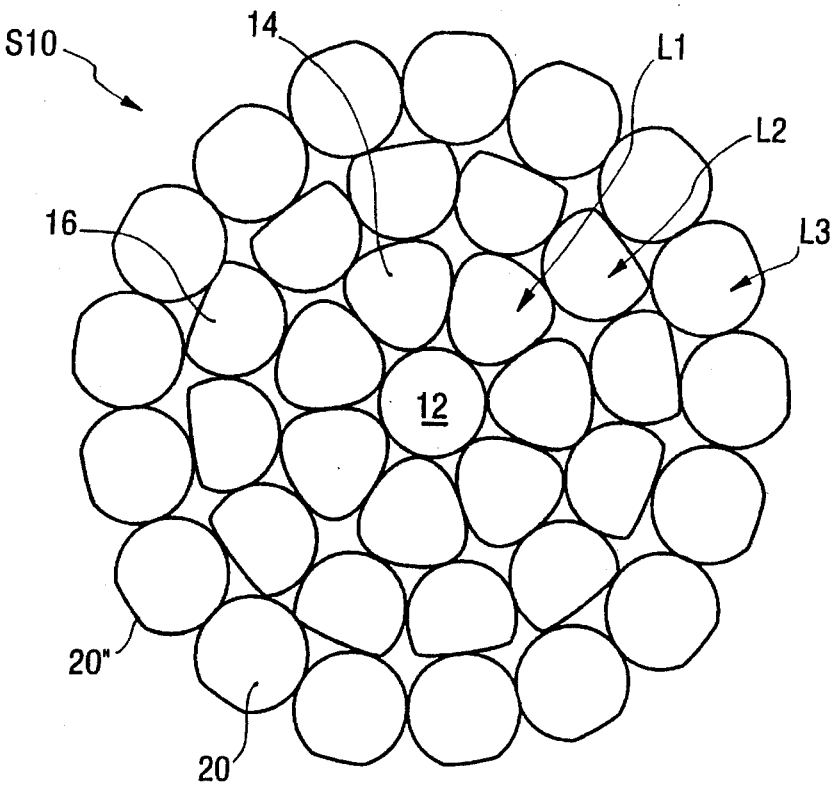
FIG. 10 is similar to FIG. 9 except that the third layer is also sized or compressed.
Figure 12:
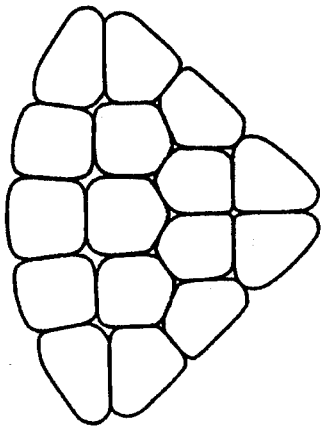
FIG. 12 is similar to FIG. 11 but wherein the sectored strand is formed from a 5+11 circular conductor.

While FIGS. 5–8 show strands consisting of a central layer comprised of a single core wire enclosed by two outer multi-wire layers, and FIGS. 9 and 10 show a central single wire layer or core surrounded by three outer layers, it is also possible to wind one or more outer layers about a first or central layer consisting of one or more wires, as suggested in FIG. 12. In FIG. 12 a 5+11 construction is shown wherein 11 wires are wound about a central layer consisting of 5 wires.

Compressed strands have become important, and provide advantages over existing strand conductors. For one, such compressed strands exhibit smaller diameters. They require less insulation, as aforementioned. Additionally, because of the compression within dies, such strands become less sensitive to process errors and slight variations or deviations in the dimensions of the individual wires or strands. The sizing dies force the wires in a given layer together, thereby reducing the effect of tolerance variations. Compressed strands of the type described, which are formed by passage through a die, are less expensive to manufacture and can provide area reductions of 0–20%, which is typical or common for many conductor metals including copper, most aluminum and aluminum alloys.

In some countries, sectored conductors find numerous applications. A sectored conductor is one in which the cross-section of the conductor is not circular but forms a sector of a circle or is pie-shaped. The size of the sector or the angle defined by its straight sides or flat surfaces may vary. Commonly, sectored conductors are bounded by a circular arc and two radial flat surfaces which are arranged 90° to one another. The multi-wire compressed stranded conductors described above can be formed into sectored conductors when produced as interim steps in the manufacture of the sectored conductors. Thus, referring to FIG. 11, there is shown a 1+7+12 sectored conductor in which the initial circular 1+7+12 conductor may be formed as previously described in order to compress the conductors. The round or circular assemblies of wires are then formed into a sector as shown by passing the assembly through a set or series of sets of sector rollers. In FIG. 12, a 5+11 compressed sectored conductor is shown which, again, is formed following the interim production of a 5+11 circular corresponding conductor. As indicated, the angle of the sector is not critical and may include angles of 60, 90, 120, 180 or, in fact, any number of degrees to suit the conductor design.

Figure 2:
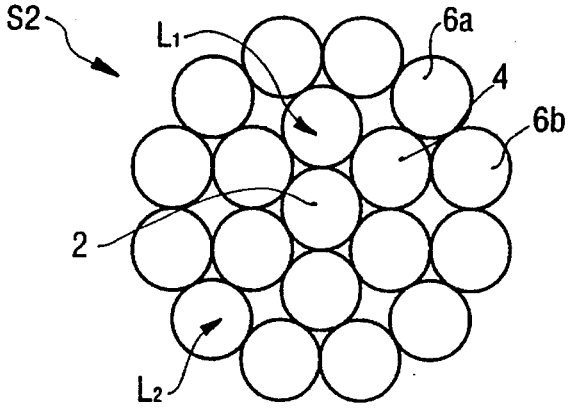
FIG.2 (PRIOR ART)
FIG. 2 is similar to FIG. 1, but showing a 19 conductor strand known in the art as a "smooth body" strand, in which pairs of adjacent wires in the outer most layer are perched on the surfaces of the wires of the intermediate layers.
Figure 3:
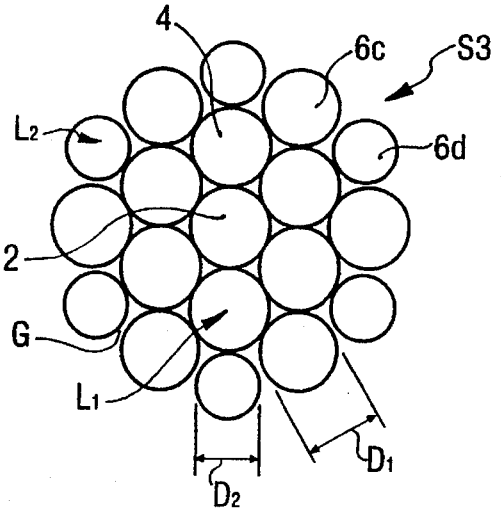
FIG.3 (PRIOR ART)
FIG. 3 is similar to FIGS. 1 and 2, but showing a prior art construction of the type disclosed in U.S. Pat. No. 4,471,161, in which the outer layer is formed of some wires having the same diameter as those of the inner layers and which alternate with wires of smaller diameter, in which the large diameter wires of the outer layer are received within the interstitial grooves of the wires of the intermediate layer while the wires of smaller diameter are perched on the radially outermost crests of the intermediate wires.
Figure 4:
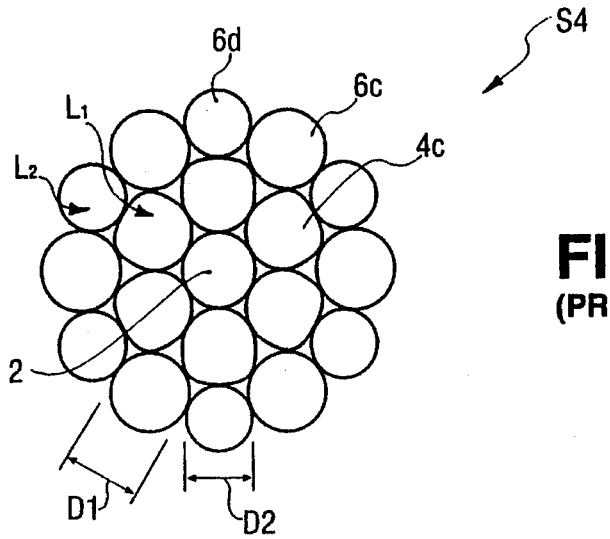
FIG.4 (PRIOR ART)
FIG. 4 is similar to FIG. 3 with the exception that the central core wire and the first layer of six wires is compressed, through a die, to reduce the areas of the intermediate layer wires and provide substantially fiat surfaces facing radially outwardly to permit the smaller diameter wires in the outer layer to enable the wires in the outer layer to be closer to each other than in the strand shown in FIG. 3.
Figure 13:
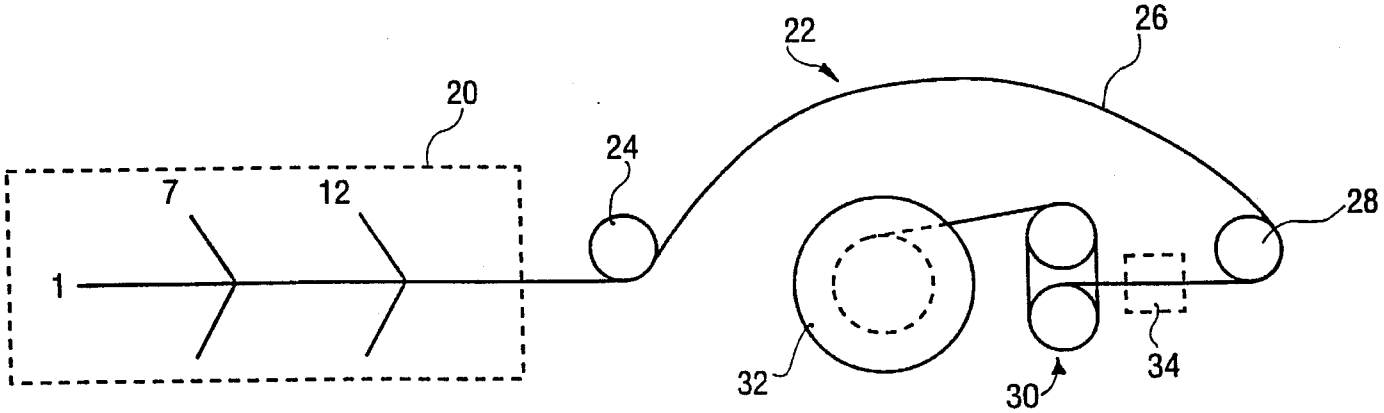
FIG. 13 is a schematic representation of a double twist machine for producing the strand constructions shown in FIGS. 5–12.

Referring to FIG. 13, a schematic sketch is illustrated for a machine that includes a double twister for forming compressed cables in accordance with the present invention. Thus, in FIG. 2, there is shown a closing area 20 which is arranged to close 1+7+12 conductors to form the arrangements illustrated in FIGS. 5–10. In the closing area 12, the cables are arranged in the desired orientations and compressed as needed. The strands at this point can have form factors of 80–85%, or preferably 81–84%, especially if the circular strand assemblies are further to be further compressed. The compressed circular cable is then advanced to the double twist machine 22 which includes initial or input pulley 24, bow 26, and outlet or final pulley 28. Once inside the double twist machine, and after having been twisted to the extent desired, a takeup 30 is used to draw the wires which are then wound onto a spool or bobbin 32.

When the stranded conductors are to be sectored, there is provided a sector rolling area 34 between the output or final pulley 28 and the takeup 30, the takeup 30 drawing the wires through the sectored rolling area for imparting the desired sectored configurations.

When the strand reaches the region between the pulley 28 and the takeup 30 it is possible to wind the wire on the takeup, die compact the wire to produce a circular compressed wire having fill factors of 84–99%, or sector the strand to compress it to fill factor levels of 84–99%. Typically, such fill factors at the rolling area 34 are increased to approximately 86–90%. As suggested, the wires can be formed into any desired sector configuration by passing the circular assemblies through a set or series of sets of sector rollers at the sector rolling area 34. This can be done in line (no separate process) in the preferred embodiment of the process (i.e. double twist machine). However, it should be clear that the process is not limited to such a process. The angle of the sector rolls could include 60, 90, 120, 180 or any other number of degrees to suit the conductor design. The approach can be equally applicable to pre-spiraled sectored conductors as well as to straight sectors.

Figure 11:
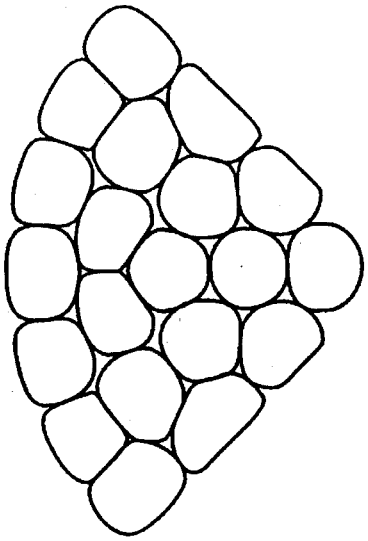
FIG. 11 illustrates a sectored strand construction in accordance with the present invention formed from the strand constructions of the type shown in FIGS. 5–8 consisting of a 1+7+12 circular conductor.

Although FIG. 13 illustrates a closing area which can be used to produce the compressed sectored conductor shown in FIG. 11, (e.g. 95 $mm^2$90° copper sector), the compressed sector conductor shown in FIG. 12 may, for example, consist of a 35$mm^2$90° straight sectored conductor.

While this invention has been described in detail with particular reference to the preferred embodiments thereof, it will be understood that variations and modifications can be effective within the spirit and scope of the invention as described herein and as defined in the appendant claims.

I claim:

1. A multi-wire strand of unilay construction comprising a central layer consisting of at least one wire; at least one additional layer consisting of a plurality of wires stranded about said central layer, at least two of said layers consisting of more than one wire and the number of wires in said layers which consist of more than one wire being such that the number of wires in adjacent layers are integers that are not divisible by a common number with the exception of the integer one, the wires in at least one of the layers being compressed to provide area reductions, and the number of wires in each of the layers being selected such that adjacent wires in each of the layers, with appropriate area reductions, are substantially in contact with each other and the strand configuration has a stable substantially circular cross-section.

2. A multi-wire strand as defined in claim 1, wherein one layer consisting of a plurality of wires is compressed to present substantially flat radially outwardly facing surfaces, and wires of another layer consisting of a plurality of wires wound on said one layer circular and abut against said substantially flat surfaces.

3. A multi-wire strand as defined in claim 2, wherein said one layer contains 7 wires and said another layer contains 12 wires.

4. A multi-wire strand as defined in claim 2, further comprising an insulation layer covering said another layer.

5. A multi-wire strand as defined in claim 3, wherein said one and another layers are both compressed to present substantially flat radially outwardly facing surfaces, whereby the strand exhibits a smoother cylindrical surface.

6. A multi-wire strand as defined in claim 2, wherein said one layer contains 6 wires and said another layer contains 11 wires.

7. A multi-wire strand as defined in claim 6, further comprising an insulation layer covering said another layer.

8. A multi-wire strand as defined in claim 6, wherein said one and another layers are both compressed to present substantially flat radially outwardly facing surfaces, whereby the strand exhibits a smoother cylindrical surface.

9. A multi-wire strand as defined in claim 1, wherein three layers each consisting of a plurality of wires are comprising 7 wires in a first layer, 12 wires in a second layer and 17 wires in a third layers.

10. A multi-wire strand as defined in claim 9, wherein said first and second layers are compressed.

11. A multi-wire strand as defined in claim 9, wherein all said three layers are compressed.

12. A multi-wire strand as defined in claim 1, wherein area reductions are within the range of 0 to approximately 20%.

13. A multi-wire strand as defined in claim 1, wherein said wires in both said central layer and in said at least one additional layers are nominally of the same diameter.

14. A method of forming a multi-wire strand of unilay construction comprising the steps of stranding at least one additional layer consisting of a plurality of wires about a central layer consisting of at least one wire, at least two of said layers consisting of more than one wire and the number of wires in said central layer and additional layers which consist of more than one wire being such that the number of wires in adjacent layers are integers that are not divisible by a common number with the exception of the integer one; and compressing the wires in at least one of the layers to provide area reductions therein, the number of wires in each of the layers being selected such that adjacent wires in each of the layers, with appropriate area reductions, are substantially in contact with each other and the strand configuration has a stable substantially circular cross-section.

15. A method as defined in claim 14, wherein a second layer consisting of a plurality of wires applied about a first layer consisting of a plurality of wires.

16. A method as defined in claim 14, wherein one of said additional layers is compressed to present substantially flat radially outwardly facing surfaces.

17. A method as defined in claim 14, wherein one layer consisting of a plurality of wires is wound with 7 wires and wires of another layer consisting of a plurality of wires wound on said one layer wound with 12 wires.

18. A method as defined in claim 17, further comprising the step of applying an insulation layer to said another layer.

19. A method as defined in claim 14, wherein two additional layers are wound on said central layer, and wherein both said additional layers are compressed to present substantially flat radially outwardly facing surfaces, whereby the strand exhibits a smoother cylindrical surface.

20. A method as defined in claim 14, wherein one layer has 6 wires and another layer wound on said one layer has 11 wires.

21. A method as defined in claim 14, wherein the strand is passed through a sizing die.

22. A method as defined in claim 14, wherein three additional layers are wound on said central layer and consist of 7 wires in said first additional layer, 12 wires in a second additional layer and 17 wires in a third additional layer.

23. A method as defined in claim 14, wherein area reductions are within the range of 0 to approximately 20%.

24. A method as defined in claim 14, wherein said wires in both said central layer and in said at least one additional layer are nominally of the same diameter.

25. A sectored multi-wire strand of unilay construction comprising a central layer consisting of a least one wire; at least one additional layer consisting of a plurality of wires stranded about said central layer, at least two of said layers consisting of more than one wire and the number of wires in said layers which consist of more than one wire being such that the number of wires in adjacent layers are integers that are not divisible by a common number with the exception of the integer one, the wires in at least one of the layers being compressed to provide area reductions and the number of wires in each of the layers being selected such that adjacent wires in each of the layers, with appropriate area reductions, are substantially in contact with each other and the strand configuration has a stable substantially sectored cross-section.

26. A sectored multi-strand as defined in claim 25, wherein area reductions are within the range of 0 to approximately 20%.

27. A sectored multi-strand as defined in claim 25, wherein said wires in both said central layer and in said at least one additional layer are nominally of the same diameter.

28. A method of forming a sectored multi-wire strand of unilay construction comprising the steps of stranding at least one additional layer consisting of a plurality of wires about a central layer consisting of at least one wire, at least two of said layers consisting of more than one wire and the number of wires in said central layer and additional layers which consist of more than one wire being such that the number of wires in adjacent layers are integers that are not divisible by a common number with the exception of the integer one; compressing the wires in at least one of the layers to provide area reductions therein, the number of wires in each of the layers being selected such that adjacent wires in each of the layers, with appropriate area reductions, are substantially in contact with each other and the strand configuration has a stable substantially circular cross-section; and forming the strand of circular cross-section to impart a sectored configuration to the strand.

29. A method as defined in claim 28, wherein area reductions are within the range of 0 to approximately 20%.

30. A method as defined in claim 28, wherein said wires in both said central layer and in said at least one additional layer are nominally of the same diameter.

* * * * *